US006421922B2

(12) United States Patent
Beutel et al.

(10) Patent No.: US 6,421,922 B2
(45) **Date of Patent: *Jul. 23, 2002**

(54) POWER DRIVEN HAIR CLIPPER

(75) Inventors: Kurt Beutel, Flörsheim; Wolfgang Franke, Langen, both of (DE)

(73) Assignee: Braun GmbH, Kronberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/884,665

(22) Filed: Jun. 19, 2001

Related U.S. Application Data

(63) Continuation of application No. PCT/EP99/09886, filed on Dec. 14, 1999.

(30) Foreign Application Priority Data

Dec. 21, 1998 (DE) ..... 198 59 016

(51) Int. Cl.[7] ..... B26B 19/06
(52) U.S. Cl. ..... 30/216; 30/210; 30/223
(58) Field of Search ..... 30/43, 43.7, 210, 30/216, 222, 223, 224

(56) References Cited

U.S. PATENT DOCUMENTS

| | | | | | |
|---|---|---|---|---|---|
| 1,729,332 A | * | 9/1929 | Dremel | 30/223 |
| 1,997,096 A | | 4/1935 | Andis | 30/199 |
| 2,194,465 A | * | 3/1940 | Bott | 30/43 |
| 2,271,053 A | * | 1/1942 | Wahl | 30/224 |
| 2,741,026 A | | 4/1956 | Guenther | 30/210 |
| 2,790,236 A | | 4/1957 | Andis | 30/210 |
| 3,101,535 A | | 8/1963 | Andis | 30/29.5 |
| 3,589,007 A | * | 6/1971 | Walton | 30/210 |
| 4,328,616 A | * | 5/1982 | Andis | 30/216 |

FOREIGN PATENT DOCUMENTS

| | | | |
|---|---|---|---|
| DE | 0 181 587 | 11/1964 | |
| DE | 23 43 116 | 8/1973 | B26B/19/10 |
| DE | 26 46 818 A | 5/1977 | B26B/19/02 |
| GB | 2 294 230 | 4/1996 | B26B/19/06 |
| WO | WO 98/47673 | 10/1998 | B26B/19/06 |

OTHER PUBLICATIONS

PCT Int'l Search Report in corresponding application PCT/EP99/09886, dated Apr. 7, 2000.

co–pending application, co–filed (Jun. 19, 2001), co–assigned U.S. Ser. No. 09/884,666, entitled "Power Driven Hair Clipper", Atty. Dkt. No. B–06223, naming inventors Kurt Beutel, Wolfgang Franke, Ludwig Hess and Karl–Heinz Schadt.

* cited by examiner

*Primary Examiner*—Hwei-Slu Payer
(74) *Attorney, Agent, or Firm*—Edward S. Podszus

(57) ABSTRACT

The invention is directed to a power driven hair clipper (HSM), comprising a drive mechanism provided in a housing (1) and a clipper head (S) equipped with a clipper comb (3) and a reciprocating clipper blade (4, 82), wherein provision is made for a foil (47) between the clipper comb (3) and the clipper blade (4, 82), such that an engagement surface (A2) of the clipper blade (4, 82) provided opposite the row of cutting teeth (42, 43) is carried on the foil (47) in sliding relationship thereto.

21 Claims, 11 Drawing Sheets

Fig. 13
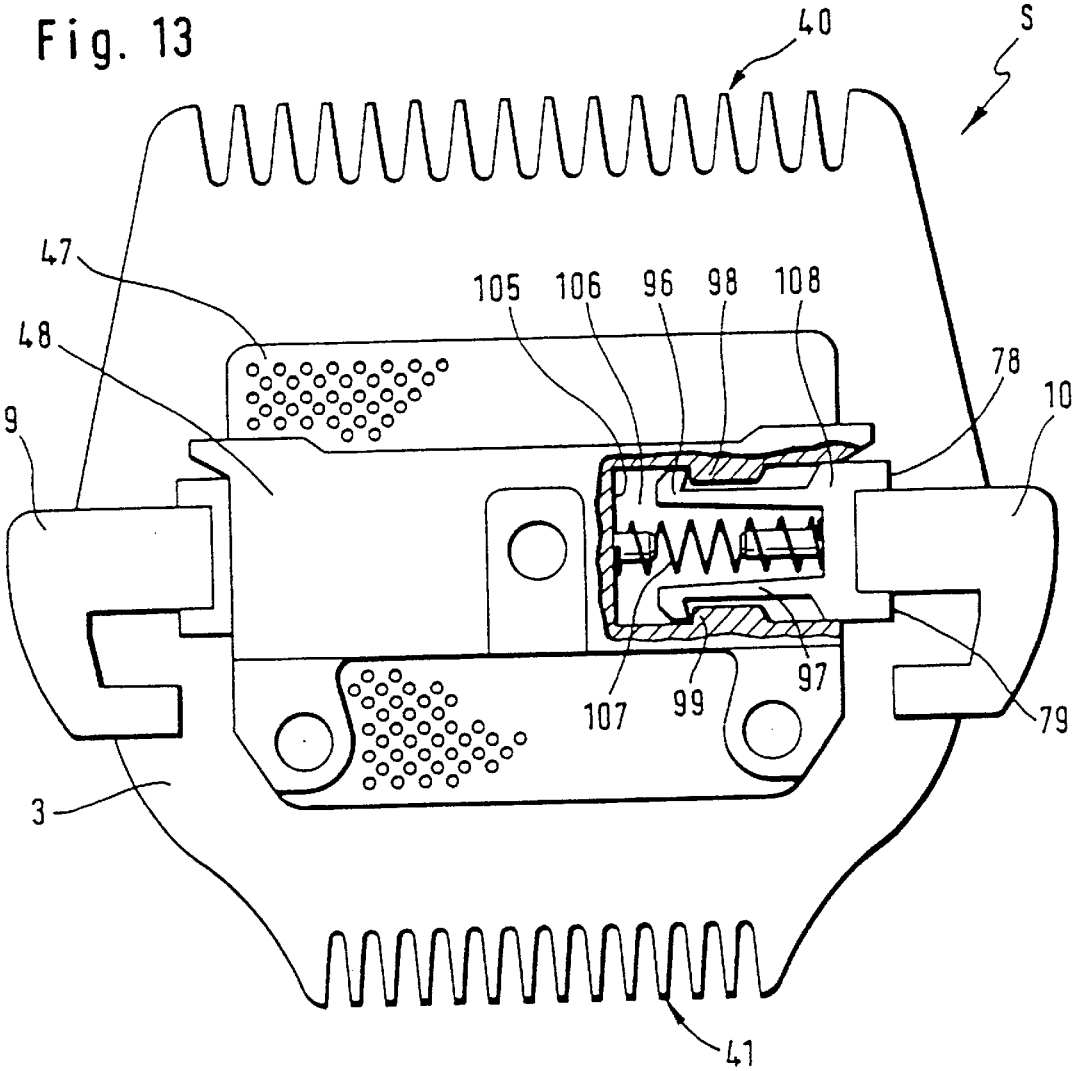
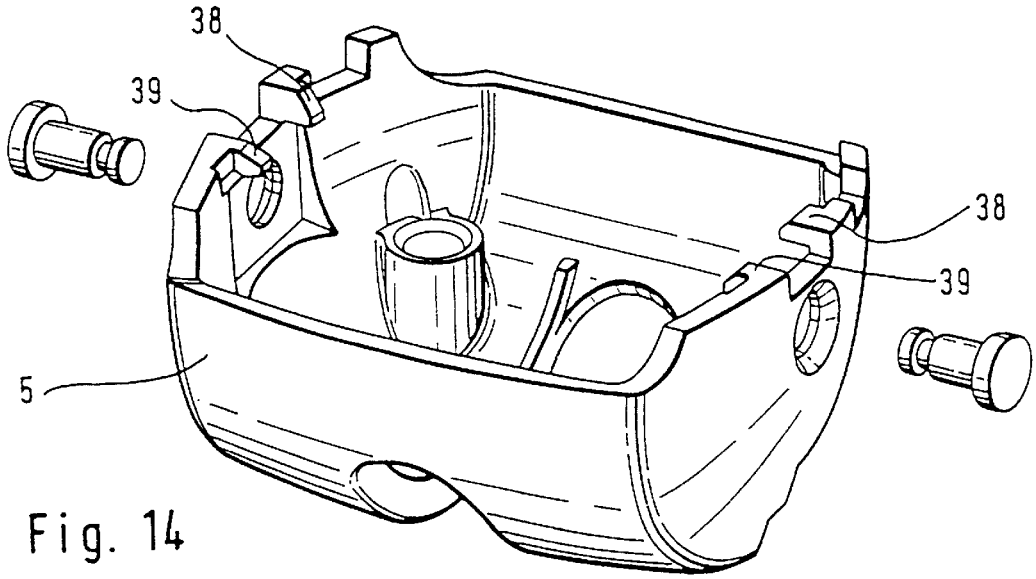
Fig. 14

POWER DRIVEN HAIR CLIPPER

This is a continuation of International Application No. PCT/EP99/09886, pending, with an International filing date of Dec. 14, 1999.

FIELD OF THE INVENTION

This invention relates to a power driven hair clipper.

BACKGROUND

A power driven hair clipper of the type initially referred to is known from U.S. Pat. No. 2,741,026. The cutting head, formed by an outer blade and an inner cutting blade driven to oscillate, is rigidly fastened to the yoke arms of the casing head constructed in a U-shaped configuration. The arcuate shape of the outer blade with its two rows of cutting teeth permits the hair clipper and the outer blade fastened thereto to execute a restricted pivot movement of 9°, while the relatively large distance of the cutting head's row of teeth used at a time to the biggest diameter of the hair clipper's casing is intended to enable both rows of teeth to be used for trimming purposes.

A power driven hair clipper is further known from U.S. Pat. No. 1,997,096, having a cutter head mounted for pivotal motion into corresponding positions for shaving and trimming, comprising a supporting element mounted for controlled pivotal motion along a curved track, a comb plate with only one row of teeth, and a cutter blade held in engagement with the comb plate by means of a resilient tension plate resting on the supporting element. An actuating element extending from the upper end of the casing transmits the driving motion to the cutter blade. A friction element acted upon by a spring element is arranged in the supporting element in such a way that it is urged against the upper surface of the hair clipper's casing in order to hold the cutter head in any given pivot position by frictional pressure engagement. For the cutter head to be displaceable from its position of adjustment, the predetermined frictional force has to be overcome. This can lead during clipper operation to undesirable changes of position, especially since frictional forces tend to decrease in the course of using the hair clipper.

From GB-A-2 294 230 there is known a power driven hair clipper with a cutter head mounted for pivotal motion in all directions, whose pivotability is assured by a ball and socket connection between the housing and the cutter head. The cutter head, comprised of a supporting element and a housing cover member, includes a pair of blades, each equipped with two rows of cutting teeth extending parallel to each other but arranged in the cutter head in such a way that only one of the cooperating rows of cutting teeth on the pair of blades projects out of the cutter head housing. For the second row of cutting teeth to be brought into use, the cutter head has to be opened to enable the pair of blades to be turned through 180° inside the cutter head.

From PCT-WO 98/47673 there is known a clipper head for a power driven hair clipper, comprising a supporting element, a clipper comb fastened thereto, and a clipper blade urged into engagement with the clipper comb via a driving element arranged to oscillate, under the action of a spring element bearing against the supporting element. A coupling element for transmitting the movement from the drive mechanism of the hair clipper to the clipper blade is provided on the driving element. To reduce the friction between the clipper comb and the clipper blade provision is made between the ends of the clipper comb and the clipper blade on the side remote from the row of cutting teeth for a friction-reducing component which is attached to the reciprocating clipper blade and is hence likewise set in reciprocating motion. For cleaning and replacement purposes, the supporting element of the clipper head is attachable to the housing by means of a clip connection.

SUMMARY OF THE INVENTION

It is an object of the present invention to improve in a power driven hair clipper of the type initially referred to the sliding ability of the reciprocating clipper blade relative to the clipper comb.

According to the invention this object is accomplished in a power driven hair clipper of the type initially referred to with the features identified here in.

According to the invention the clipper blade has its row of cutting teeth in engagement with the row of cutting teeth of the clipper comb while its engagement surface opposite its row of cutting teeth engages the foil, thereby producing a slightly in-clined position of the clipper blade to the clipper comb. This has as initial result that the sliding surface and consequently also the sliding surface of the clipper blade on the clipper comb, which is exposed to adhesive forces, is minimized. Furthermore, on account of the relatively narrow area with which the clipper blade makes engagement with the foil, the occurring sliding friction of the clipper blade with the opposed bearing surface formed by the foil is minimized. In a preferred embodiment of the invention the foil is fastened to the clipper comb and accordingly immovably arranged in the clipper head.

One embodiment of the invention is characterized in that the foil is fastened to the clipper comb by means of a chassis.

One significant advantage of the invention is afforded in that engagement of the engagement surface of the clipper blade with the foil enables an inclined position of the clipper blade relative to the row of cutting teeth to be obtained. Owing to this arrangement the surface adhesion occurring in cases where plane surfaces are in relative engagement is minimized by the attendant reduction in surfaces sliding relative to each other.

In a preferred embodiment of the invention at least one side of the foil is provided with a recessed surface structure. In a further aspect of this embodiment the recesses are constructed as holes passing through the foil. An alternative embodiment of the invention is characterized in that the recesses are constructed as blind-end bores. In another embodiment of the invention the recesses are formed by bars. In yet another advantageous embodiment of the invention the recesses are formed by holes and bars. To reduce the friction between the clipper blade and the foil still further, a greatly advantageous embodiment of the invention provides for the presence of a lubricant in the recesses. The recesses in the foil constitute lubricant depots with long-lasting effect.

According to another embodiment of the invention the surface structure of the foil is manufacturable by electroforming. This may take place, for example, in conjunction with an electroforming process of the foil as such. In still another embodiment of the invention the surface structure is manufacturable by an embossing process. A further embodiment of the invention is characterized in that the foil is formed of a plastics material. In an alternative embodiment the foil is made of a metal.

An embodiment of the present invention will be described in the following with reference to the accompanying drawings.

BRIEF DESCRIPTION OF THE DRAWINGS

FIG. 13 is a side view of the clipper comb with the chassis attached thereto and a foil, part of the chassis being broken away to expose components of the locking device;

FIG. 14 is a perspective view of the supporting element showing latching elements;

DETAILED DESCRIPTION OF PREFERRED EMBODIMENTS

Figure 1:
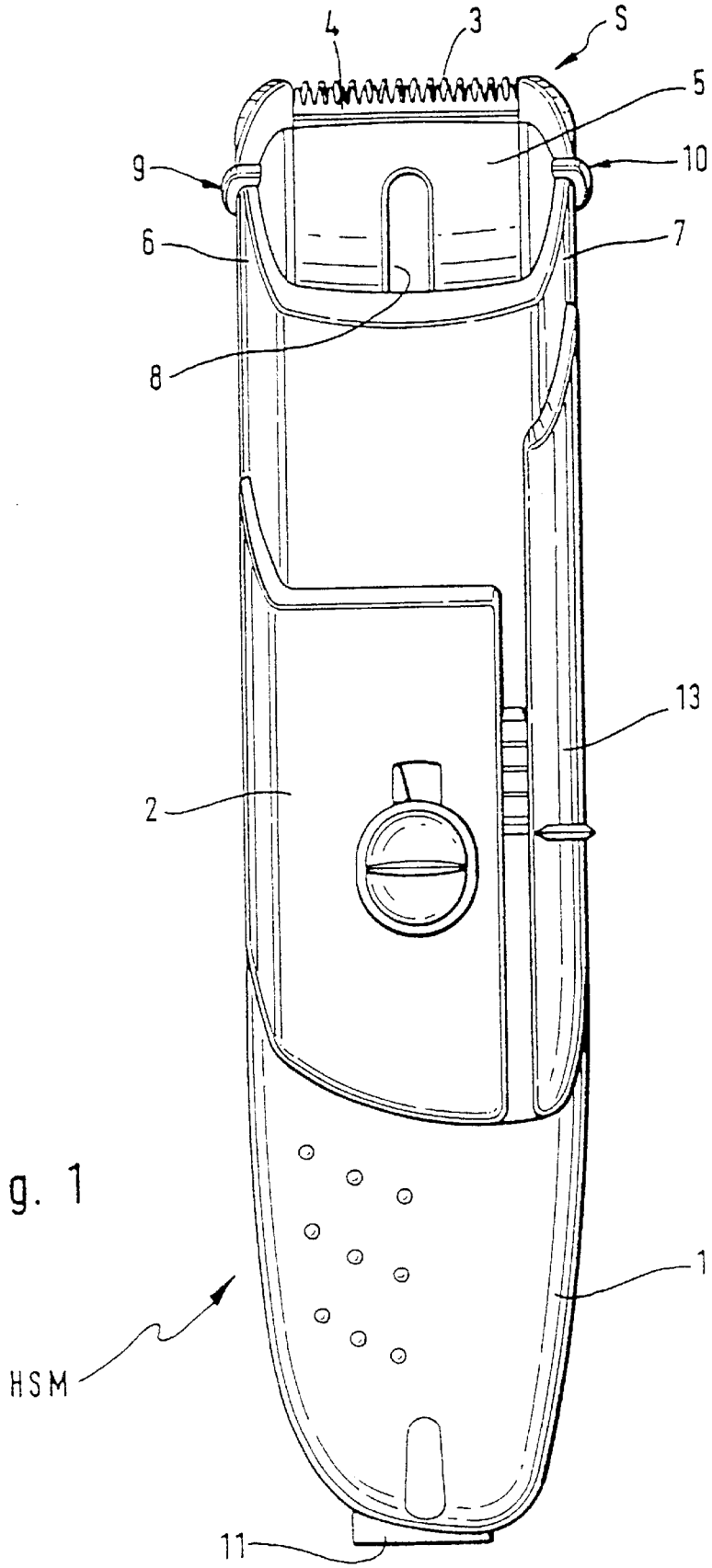
FIG. 1 is a front view of a power driven hair clipper having an actuating switch movable into various positions and a position switch.
Figure 2:
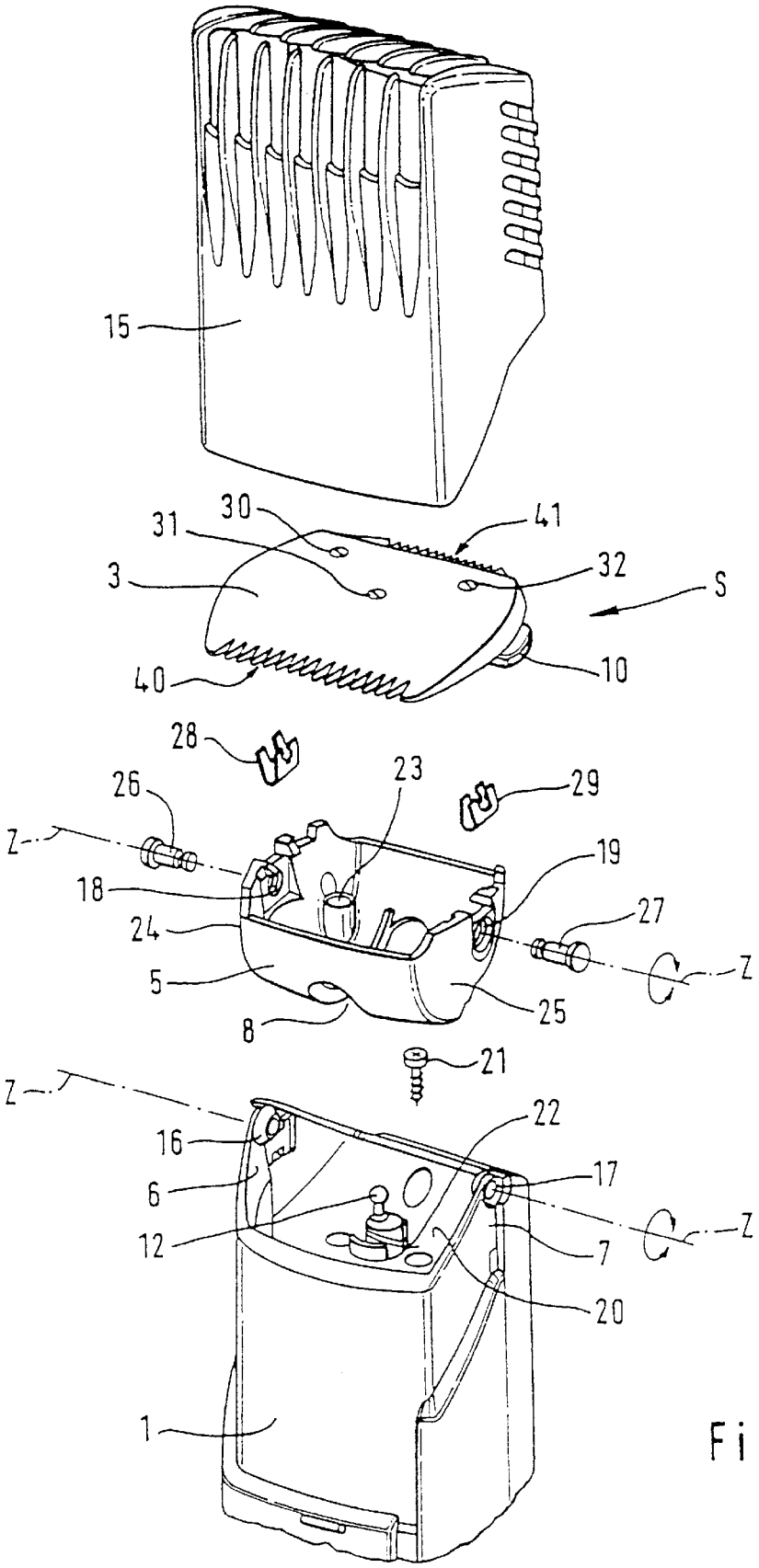
FIG. 2 is an exploded view of the upper part of a power driven hair clipper comprising a detached supporting element, a clipper head having two rows of cutting teeth, and a distancing comb seatable onto the housing.

FIG. 1 shows the front view of a power driven hair clipper HSM with an actuating switch 2 adjustably arranged on the front panel of the housing 1, a position switch 13 and a clipper head S which has a clipper comb 3 and a clipper blade 4 and is mounted on the housing 1 for pivotal motion about a pivot axis Z—see FIG. 2. For this purpose one end of the housing 1 is of a U-shaped yoke configuration so that a supporting element 5 constructed as a housing shell and carrying the clipper head S is adapted to be pivotally mounted by means of pivot bearings on the yoke arms 6 and 7. In the cylindrically shaped wall of the supporting element 5 provision is made for a cutout 8 to couple a drive member 12—see FIG. 2—of an electric drive mechanism provided in the housing 1 with a drivable clipper blade 4 according to the pivot position of the clipper head S relative to the housing 1. The clipper head S is releasably attached to the supporting element 5 by means of a locking device 9, 10. At the end of the housing 1 remote from the clipper head S provision is made for an appliance socket 11 for the indirect and/or direct operation of the hair clipper HSM.

FIG. 2 is an exploded view of the upper part of a power driven hair clipper HSM showing the supporting element 5, the clipper head S attachable thereto and a distancing comb 15 detached from the housing 1. The upper end of the housing 1 is of a yoke-type construction, with conical bearing elements 16 and 17 being integrally formed on the yoke arms 6 and 7 in order to provide a pivot bearing in conjunction with the conical bearing elements 18 and 19 of the supporting element 5. Between the two yoke arms 6 and 7 a housing head shell 20 is fastened to the housing 1 by means of fastening elements 21. In the middle of the housing shell provision is made for an opening 22 through which the drive member 12 of an electric drive mechanism accommodated in the housing 1 extends.

Figure 8:
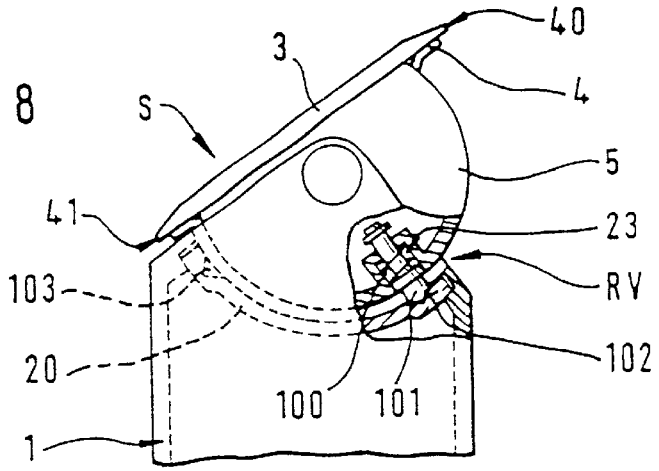
FIG. 8 is a view of part of a housing, showing stops on the housing for abutting engagement with the pivoted clipper head in a first operating position and component s of a detent device for the clipper head.
Figure 9:
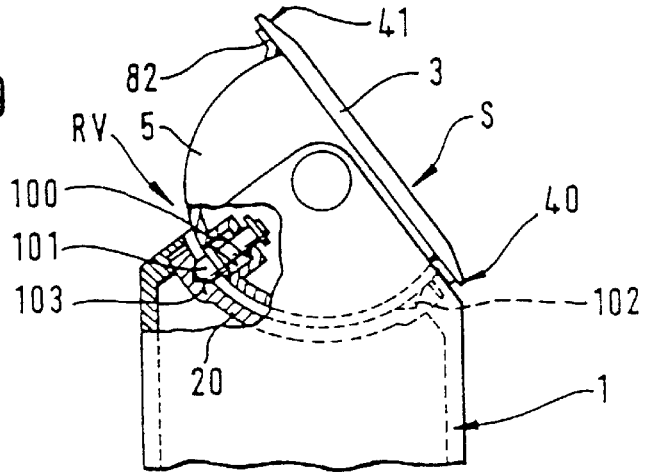
FIG. 9 is a view of part of a housing, showing stops on the housing for abutting engagement with the pivoted clipper head in a second operating position and components of a detent device for the clipper head.
Figure 10:
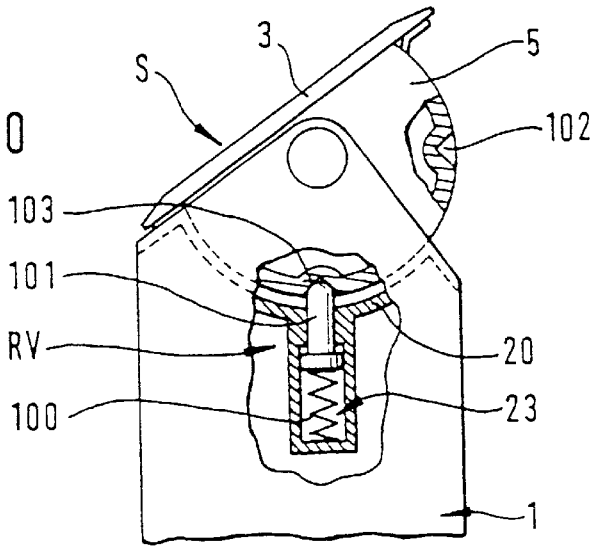
FIG. 10 is a view of part of a housing, showing stops on the housing for abutting engagement with the pivoted clipper head and components of a modified detent device for the clipper head.

The supporting element 5 is comprised essentially of a trough-shaped housing shell having a cutout 8 for passage of the electric drive member 12, and of an integrally formed chamber 23 for accommodating the components of a detent device RV—see FIG. 8 to FIG. 10. The conical bearing elements 18 and 19 are provided in opposite end walls 24 and 25 of the supporting element 5. The supporting element 5 is held for pivotal motion about the pivot axis Z by means of bearing pins 26 and 27 and spring elements 28 and 29 and the conical bearing elements 16 and 17 as well as 18 and 19.

The clipper head S is releasably attached to the supporting element 5 by means of at least one locking device 9, 10—see FIGS. 1, 11, 13, 14. The clipper comb 3 of the clipper head S has two rows of cutting teeth 40, 41 arranged opposite each other along the longitudinal sides of the clipper comb 3. The row of cutting teeth 41 extends to a smaller width than the row of cutting teeth 40. The heads of the illustrated fastening screws 30, 31 and 32 serve to fasten components of the clipper head S—in this connection see FIG. 3.

Figure 3:
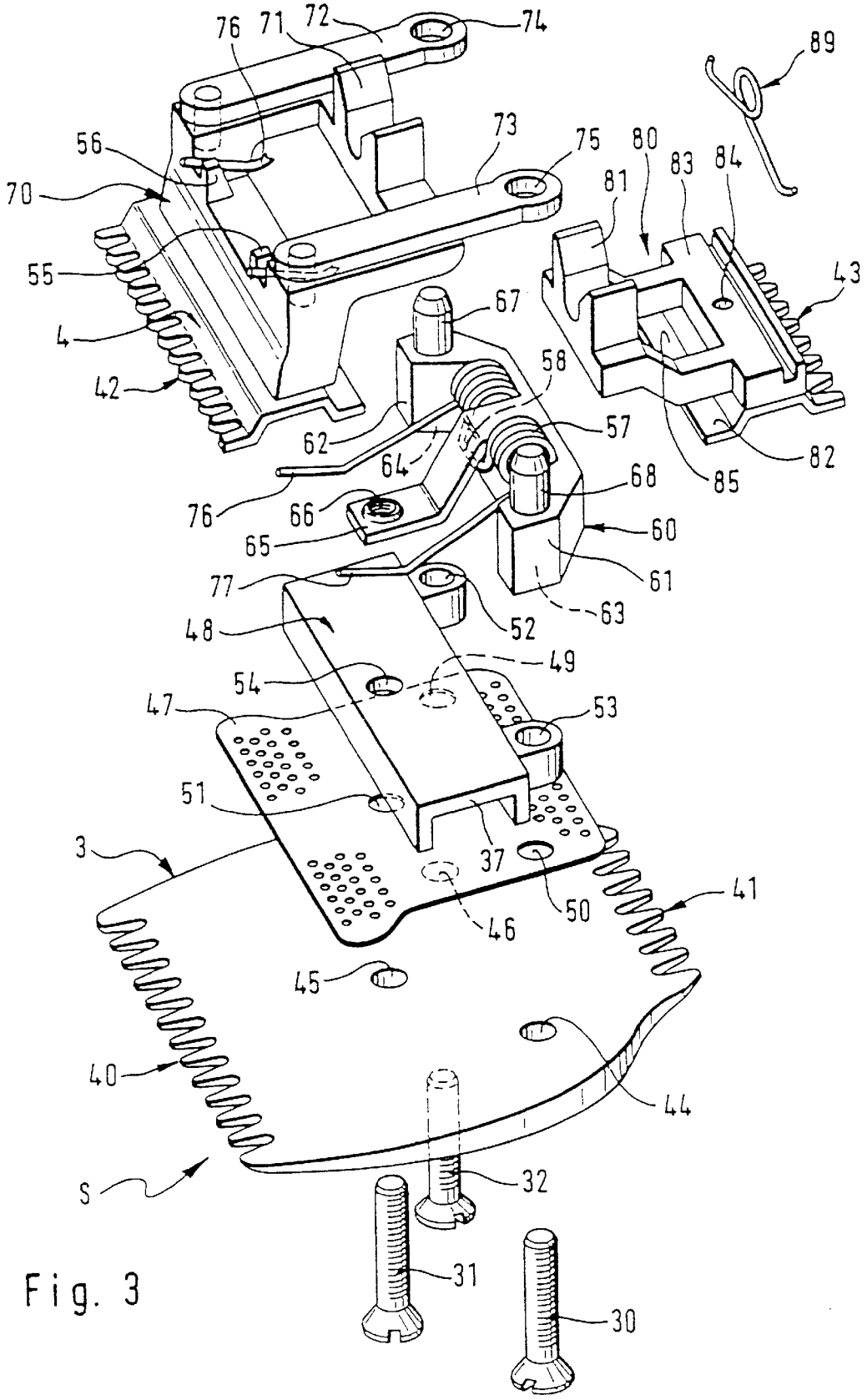
FIG. 3 is an exploded view of the components of a clipper head.

FIG. 3 shows an exploded view of the clipper head S with a perspective view of the provided components.

Two rows of cutting teeth 40 and 41 disposed in the opposing longitudinal sides of the clipper comb 3 are provided on the clipper comb 3. The clipper comb 3 has three through-holes 44, 45 and 46 for passage of the fastening screws 30, 31 and 32. Disposed on the inside of the clipper comb 3 is first a foil 47 with the through-holes 49, 50, 51 and then a chassis 48 with the through-holes 52, 53 and 54. The relatively thin foil 47 has a plurality of small holes with or without flanges or beads to receive a lubricant. The chassis 48 is of a U-shaped configuration in order to receive a locking device 9, 10 described in more detail with reference to FIGS. 10 and 11. The through-hole 54 is provided in the cross wall 37 of the U-shape joining the two longitudinal walls, whereas the through-holes 52 and 53 are provided in two lugs integrally formed on one of the longitudinal sides of the chassis 48. A bearing bracket 60 with two bracket arms 61 and 62 is associated with the chassis 48. Female threads 63 and 64 are provided in the bracket arms 61 and 62 in order to fasten to the clipper comb 3 the bearing bracket 60 and the chassis 48 by way of the through-holes 52 and 53, and the foil 47 by way of the through-holes 49 and 50, using the fastening screws 30 and 32 passing through the through-holes 46 and 44. The bearing bracket 60 is additionally secured to the clipper comb 3 via a fastening arm 65 having a tapped hole 66 for threaded engagement with a fastening screw 31 passing through the through-hole 45 of the clipper comb 3, the through-hole 51 of the foil 47 and the through-hole 54 of the chassis 48.

On the side of the bearing bracket 60 remote from the clipper comb 3 provision is made for two bearing trunnions 67, 68 for pivotally mounting a driving element 70. Fastened to the driving element 70 is a clipper blade 4 comprising a row of cutting teeth 42. In addition to this, provision is made on the driving element for a coupling element 71 and two oscillating levers 72 and 73 pivotally mounting the driving element 70 by engagement of the bearing trunnions 67 and 68 of the bearing bracket 60 with the bearing bores 74 and 75. The oscillating levers 72 and 73 are pivotally mounted on the driving element 70 by their ends opposite the bearing bores 74 and 75, for example by way of pivot bearings comprised of bearing trunnions and bearing bores. Instead of pivot bearings comprised of bearing trunnions and bearing bores it is also possible to use, for example, film hinge joints as pivot bearings.

Figure 3A:
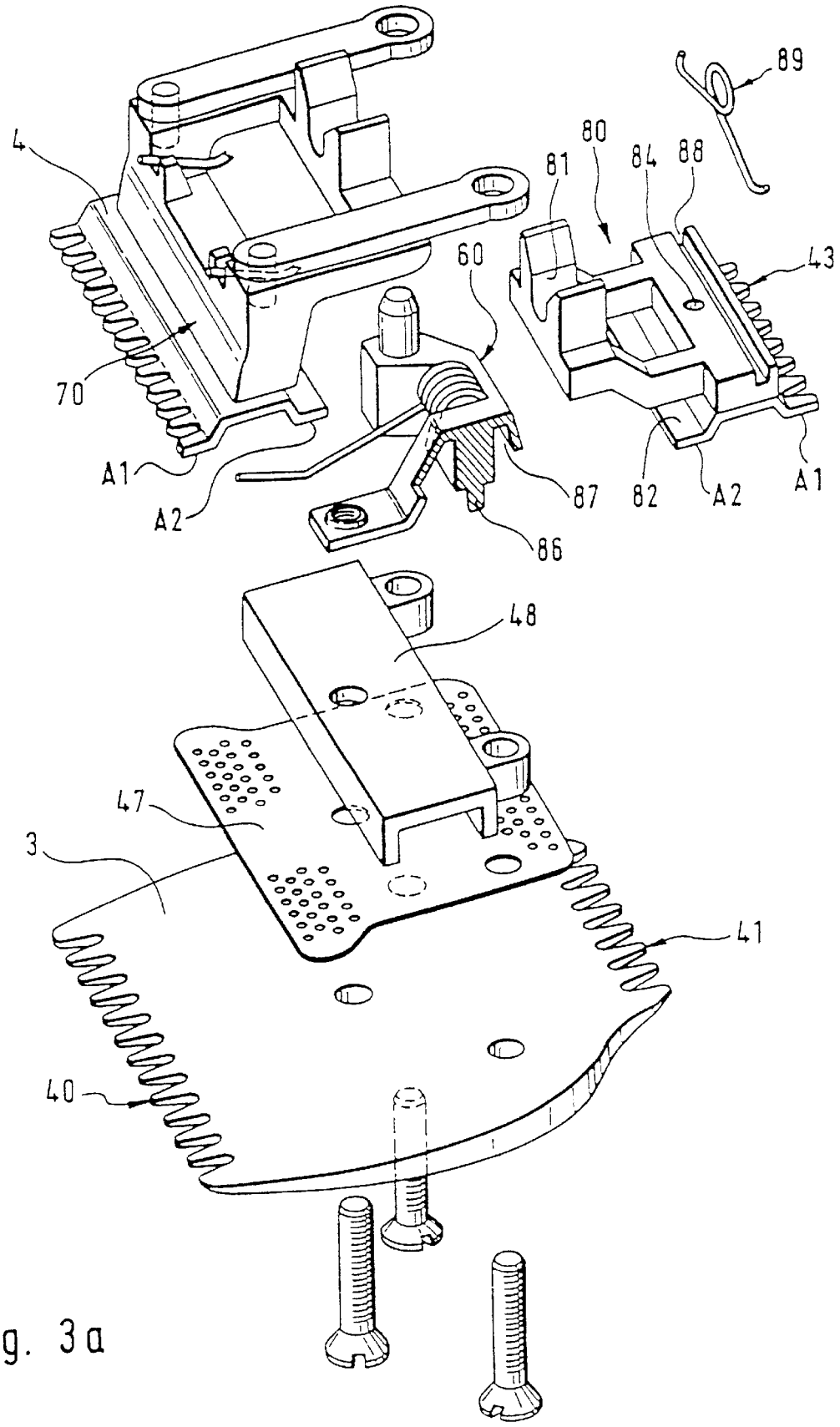
FIG. 3*a* is an exploded view of the components of the clipper head of FIG. 3, including additionally a sectional view of the bearing bracket.

The clipper blade 4 fastened to the driving element 70 has on its side close to the inside of the clipper comb 3 a groove-like recess, whereby two engagement surfaces A1, A2 are produced—see FIG. 3*a*—in order to reduce the area making sliding contact with the inside of the clipper comb 3. In the assembled state the row of cutting teeth 42 of the clipper blade 4 makes engagement with the row of cutting teeth 40 of the clipper comb 3, while the end of the clipper blade 4 opposite the row of cutting teeth 42 makes engagement with the foil 47 in order to slide to and fro on the foil 47 during operation of the clipper blade 4. To minimize friction occurring in the process between the relatively narrow projecting area of the clipper blade 4 and the foil 47, a lubricant is stored either in the holes of the foil 47 or in recesses formed by flanges surrounding the holes. The sliding bearing of the clipper blade 4 against the relatively narrow area of engagement with the foil 47 results in a slight inclination of the clipper blade 4 on the planar inside of the clipper comb 3 relative to the rows of cutting teeth 40 and 42, thereby effecting an optimal cooperation between the row of cutting teeth 40 of the clipper comb 3 and the row of cutting teeth 42 of the clipper blade 4 for the cutting of hair.

Integrally formed on the driving element 70 are two yoke arms 55 and 56 for receiving the spring arms 76, 77 of a spring element 57 fastened to the bearing bracket 60 by means of a spring arm 58 reaching under the fastening arm 65. The necessary contact pressure to effect cooperation of the clipper comb 3 with the clipper blade 4 is exerted on the clipper blade 4 by means of the spring arms 76 and 77 of the spring element 57 acting via the yoke arms 55 and 56 of the driving element 70.

On a driving element 80 provision is made for a coupling element 81 to operate the clipper blade 82 which has a row of cutting teeth 43 and is fastened to the driving element 80, and on a longitudinal web portion 83 of the driving element 80 provision is made for a bearing bore 84 for pivotally mounting the driving element 80 and the clipper blade 82. Between the bearing bore 84 and the coupling element 81 provision is made for an opening 85 through which, in the assembled state of the bearing bracket 60 and the driving element 80, the fastening arm 65 of the bearing bracket 60 is passed. In the assembled state of the clipper head S the coupling element 81 is provided adjacent to the coupling element 71.

Details of the pivotable bearing of the driving element 80 with the clipper blade 82 are shown in FIG. 3*a* and are described in more detail below. In contrast to FIG. 3, the presentation of the bearing bracket 60 of FIG. 3*a* shows a section through the middle of the bar extending in longitudinal direction, thereby providing a clear view of the bearing trunnion 86 required for the pivotal motion of the driving element 80, and a spring chamber 87. With the driving element 80 in the assembled state the bearing trunnion 86 engages in the bearing bore 84 in order to set the driving element 80 with the attached clipper blade 82 in a reciprocating pivotal motion when the coupling element 81 is coupled with the drive member 12—see FIG. 2. The necessary contact pressure of the row of cutting teeth 43 of the clipper blade 82 is exerted on the row of cutting teeth 41 of the clipper comb 3 by means of a spring element 89 seated in the spring chamber 87 in addition to having its spring legs seated in the groove-shaped spring seat 88 provided in the web portion of the driving element 80.

Like the clipper blade 4, the clipper blade 82 has a groove-like recess, thus forming two engagement surfaces A1, A2 with the clipper comb 3, whereby in the assembled state of the clipper head S the engagement surface A2 of the clipper blade 82 extending opposite to the row of cutting teeth 43 comes into sliding contact with the foil 47. The relatively narrow engagement surface A2 of the clipper blade 82 results, upon engagement with the foil 47, in a slight inclination of the clipper blade 82 relative to the row of cutting teeth 40 of the clipper comb 3, thus effecting an optimal cooperation of the row of cutting teeth 43 of the clipper blade 82 with the row of cutting teeth 41 of the clipper comb 3 for cutting hair. This arrangement leads to a reduction in size of cooperating friction surfaces, the overall friction being significantly reduced by the holes in the foil 47 or by grooves formed in the foil by means of flanges or bars. A further reduction of friction is achieved by disposing a lubricant in either the holes or grooves or recess in the foil 47.

Figure 4:
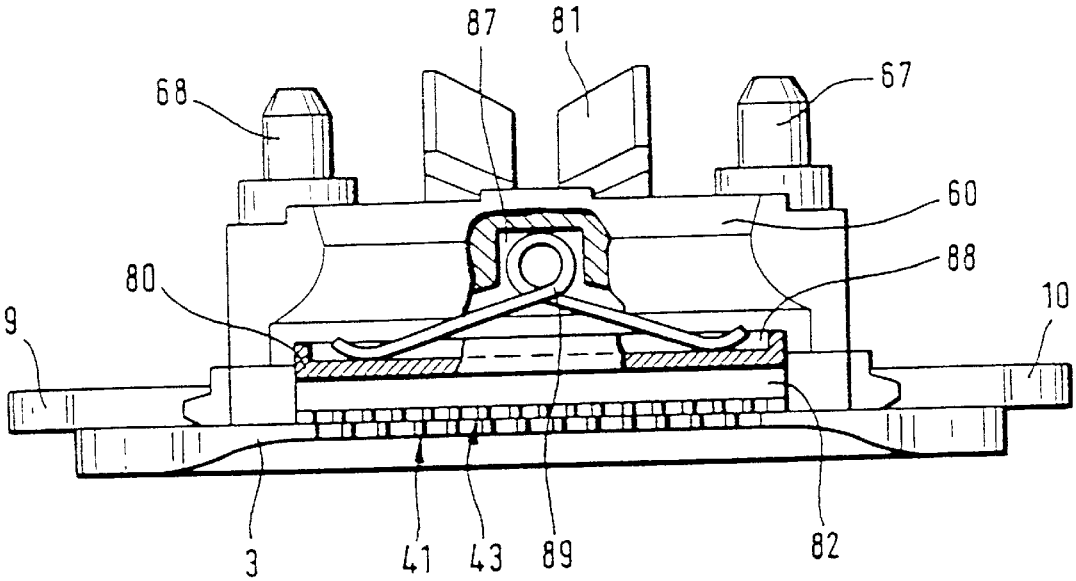
FIG. 4 is a side view of the clipper head, showing the clipper blade and a coupling element.
Figure 5:
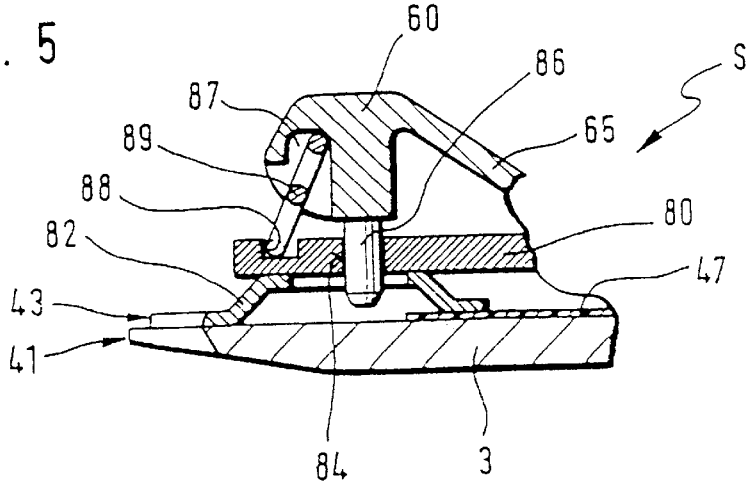
FIG. 5 is a cross-sectional view of the middle of the bearing bracket, the driving element, the clipper blades and the clipper comb.

FIGS. 4 and 5 show further details of the arrangement of the spring element 89 in the spring chamber 87 and the spring seat 88 constructed as a groove. FIG. 4 shows a view of the cutting 25 teeth of the clipper comb 3 and the clipper blade 82 as well as the bearing bracket 60, in whose spring chamber 87 a spring element 89 configured as a leg spring is received and captured. The two legs of the leg spring extend into the groove of the spring seat 88, urging the clipper blade 82, by way of the driving element 80, against the row of cutting teeth 41 of the clipper comb 3. The coupling element 81 is arranged between the two bearing trunnions 67 and 68 and capable of reciprocating.

FIG. 5 shows a cross section through the middle of the bearing bracket 60, the driving element 80, the clipper blade 82 and the clipper comb 3 of the clipper head S. The cross section also shows the engagement of the spring element 89 with a wall of the spring chamber 87 and, in addition, with a wall of the groove-shaped spring seat 88 provided in the driving element 80. The contact pressure of the spring element 89 operates to hold the clipper blade 82 with its row of cutting teeth 43 in engagement with the row of cutting teeth 41 of the clipper comb 3, in addition to causing the opposite narrow area of the clipper blade 82 to be maintained in engagement with the foil 47 resting on the clipper comb 3. The clipper blade 82 with the driving element 80 is pivotally mounted on the bearing bracket 60 by means of the bearing trunnion 86 provided on the bearing bracket 60, and the coupling element 81 provided on the driving element 80—see FIG. 4—transmits the driving motion from the drive mechanism of the power driven hair clipper HSM to the clipper blade 82. The bearing bracket 60 is fastened by means of a fastening arm 65—in this connection see FIG. 3*a*—to the clipper comb 3 by means of a fastening screw 31.

Figure 6:
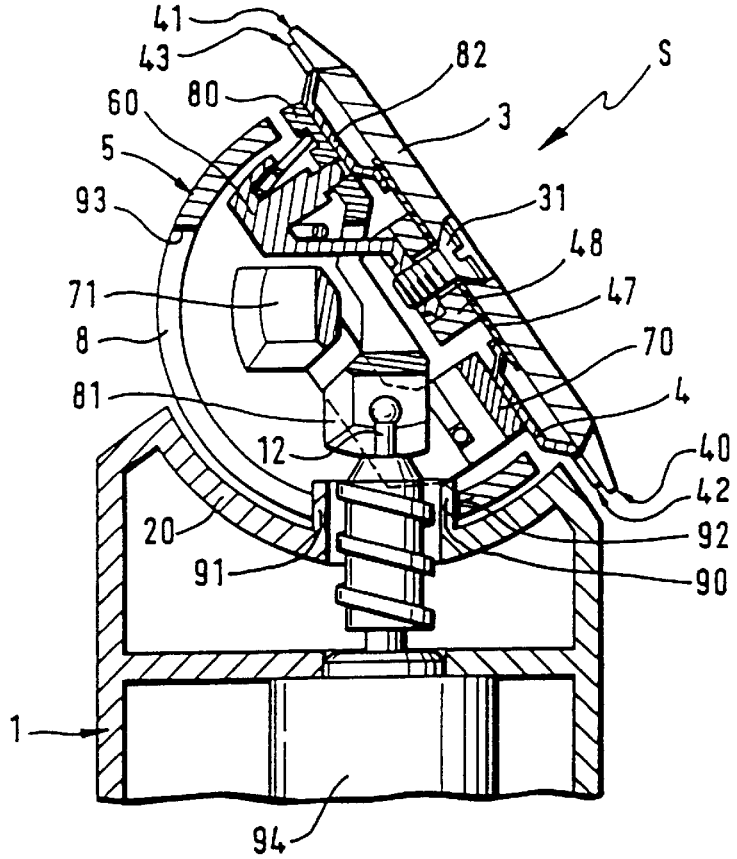
FIG. 6 is a longitudinal sectional view of the upper part of the housing, showing a clipper head in abutment with a stop on the housing, and a row of cutting teeth in the position of use.
Figure 7:
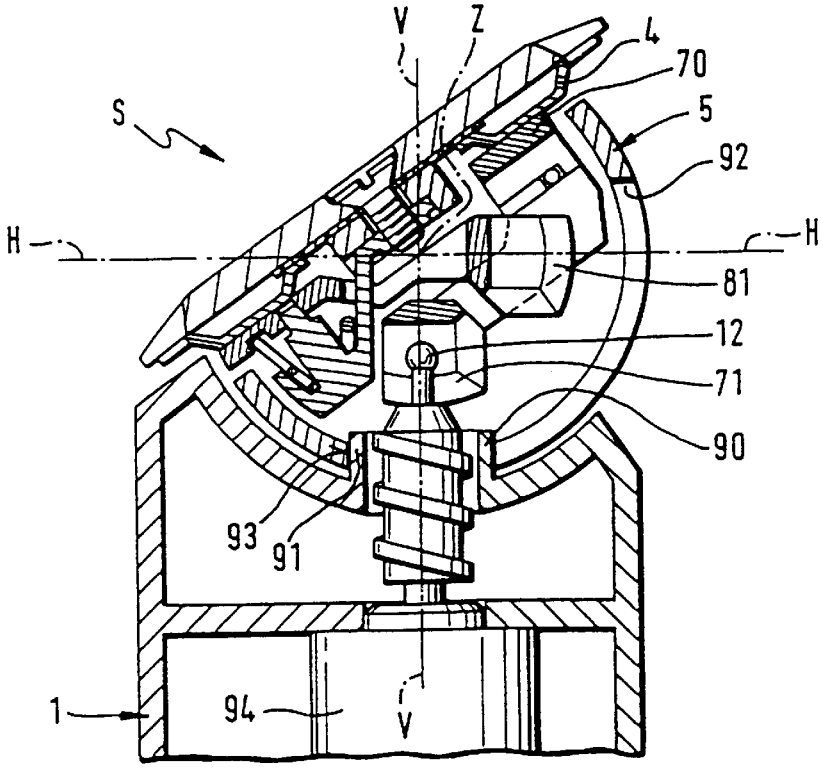
FIG. 7 is a longitudinal sectional view of the upper part of the housing, showing a clipper head in abutment with a stop on the housing, and respective rows of cutting teeth of the clipper comb and the clipper blade in the position of use.

FIGS. 6 and 7 show a cross section through the middle of the clipper head S and the upper part of the housing 1, from which it will be seen that the respective position of the clipper head S and hence of the cutting system being put to use, comprised of a clipper comb and a clipper blade, is defined by stops which are formed, for example, by wall elements 90 and 91 of the housing 1 and by wall elements 92 and 93 of the supporting element 5. The wall elements 92 and 93 are formed, for example, by means of an elongate cutout 8 provided in the housing shell of the supporting element 5. Arranged in the housing 1 is an electric motor 94 whose drive member 12, configured as an eccentric, engages in the coupling element 81 in order to drive the cutting system, which is in operating position, of the clipper head S comprised of the clipper comb 3 and the clipper blade 82. The coupling element 71 provided to drive the clipper blade 4 is disengaged from the drive member 12. The operating position of the row of cutting teeth 43 of the clipper blade 82 cooperating with the row of cutting teeth 41 of the clipper comb 3 is defined according to FIG. 6 by abutment of the wall element 92 of the supporting element 5 with the wall element 90 of the housing head shell 20 of the housing 1. In the embodiment of FIG. 6 the bearing bracket 60 and the chassis 48 and the foil 47 are fastened to the planar inner surface of the clipper comb 3 by means of the fastening screw 31. The clipper blade 4 fastened to the driving element 70 and the clipper blade 82 fastened to the driving element 80 bear with their longitudinally extending engagement surfaces A2, A1 against the foil 47 and, on account of the thickness of the foil 47, adopt a slight inclination toward their rows of cutting teeth 42 and 43, respectively.

In contrast to the representation of FIG. 6, the clipper head S in the embodiment of FIG. 7 is pivoted by a predetermined angle relative to a vertical axis V and a horizontal axis H about the pivot axis Z, whereby the wall element 93 comes to rest against the wall element 91. In this position of the clipper head S the drive member 12, constructed as an eccentric, of the electric motor 94 is coupled with the coupling element 71, causing the driving motion of the electric motor to be transmitted in the activated state via the provided driving element 70 to the clipper blade 4 so that the clipper head S, then in operating position, can be used to cut hair.

FIGS. 8, 9 and 10 show detent devices RV enabling the clipper head S to be maintained in various operating positions. FIG. 8 shows the upper part of a housing 1 with a pivotally mounted supporting element 5 which is coupled to a clipper head S. A chamber 23 for receiving a spring element 100 and a detent element 101 is provided in the supporting element 5 constructed as a housing shell. In the housing head shell 20 of the housing 1 provision is made for at least two notches 102 for receiving the detent element 101 and hence for locating the clipper head S in its pivot position. In the embodiment of FIG. 8 the detent element 101 is in engagement with the notch 102, thereby defining the operating position of the clipper blade 4 with the cooperating row of cutting teeth 40. In the embodiment of FIG. 9 the detent element 101 is in engagement with the notch 103 provided in the housing head shell 20, thereby defining the operating position of the clipper blade 82 with the row of cutting teeth 41 of the clipper comb 3. In the embodiment of FIG. 10 the chamber 23, the spring element 100 and the detent element 101 are provided in the housing 1, the detent element 101 extending through the wall of the housing head shell 20 and projecting into a notch 103 provided in the housing shell of the supporting element 5 in order to arrest the clipper head S in one of the provided operating positions. A further operating position is provided by the notch 102 in the outer wall of the housing shell of the supporting element 5.

Figure 11:
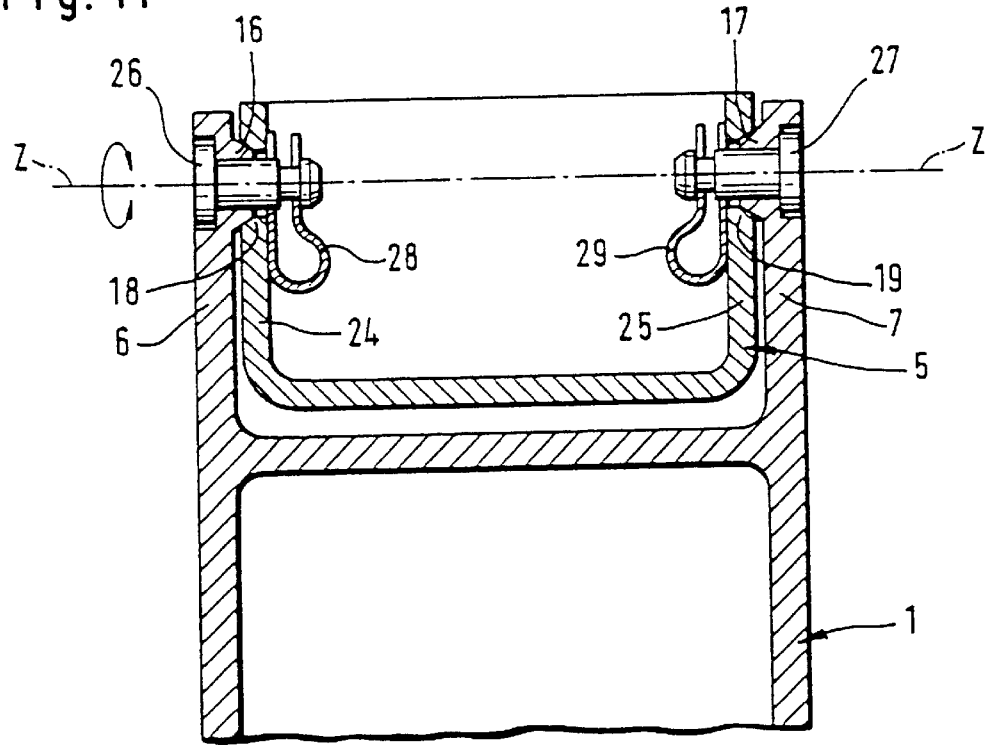
FIG. 11 is a longitudinal sectional view of the housing and the yoke arms provided thereon as well as of the supporting element in the area of the pivot bearings.
Figure 12:
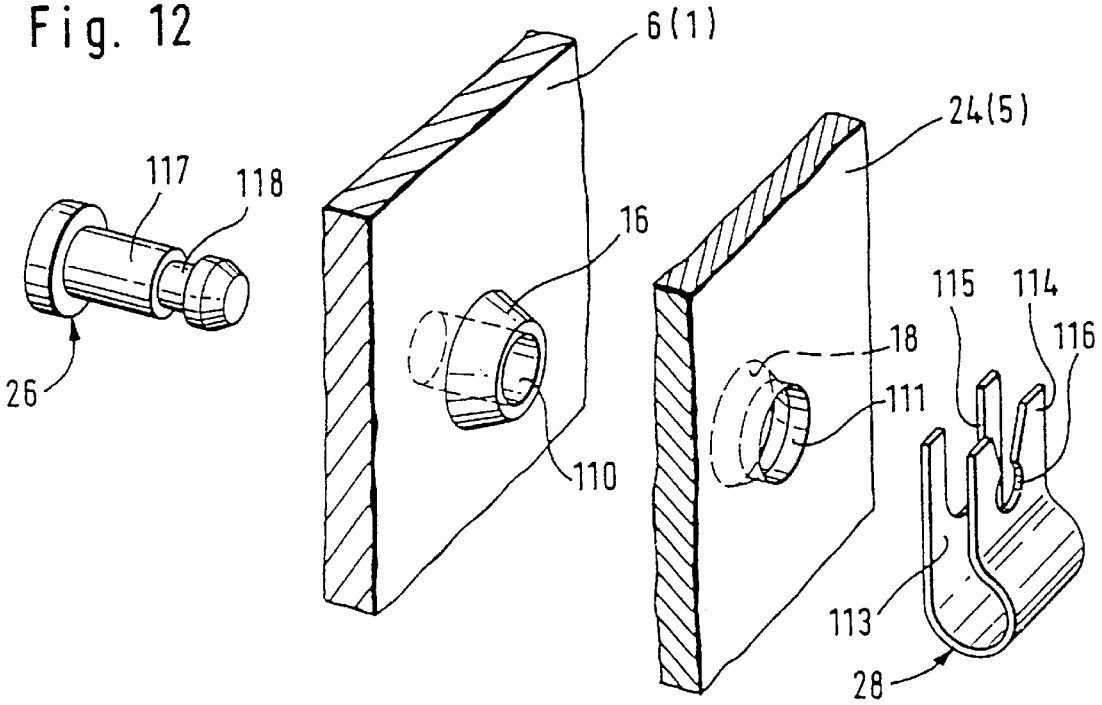
FIG. 12 is a view of details of a pivot bearing constructed in accordance with the embodiment of FIG. 11.

FIGS. 11 and 12 show details of the bearing structure of the supporting element 5 on wall elements of the housing 1, which are described below in more detail. The supporting element 5 with its end walls 24 and 25 is arranged between the yoke arms 6 and 7 of the housing 1 and pivotally mounted about the pivot axis Z by means of two pivot bearings. The two pivot bearings are identically constructed, comprising respectively a bearing pin 26, 27, a spring element 28, 29 and conical bearing elements 16, 18 and 17, 19. Details of the bearing structure are shown in FIG. 12 in an exploded view and are described below in more detail. The bearing pin 26 includes a journal 117 and a groove 118. Integrally formed on the yoke arm 6 is a conical bearing element 16 through which a bore 110 passes. The conical bearing element 18 is formed in the end wall 24 of the supporting element 5 by an integrally formed cone-like depression through which a bore 111 also passes. The spring element 28 is of a U-shaped configuration, providing legs 113 and 114 having a cutout 15 to allow passage of the bearing pin 26 and another cutout 116 to fasten the leg 114 in the groove 118 of the bearing pin 26. FIG. 11 shows the bearing structure of FIG. 12 in the assembled state in which the conical bearing elements 16 and 18 are held in slidable relative engagement by means of the spring tension of the spring element 28 in conjunction with the bearing pin 26. The opposite lying pivot bearing is of identical construction.

FIG. 13 shows a view of the inside of the clipper comb 3 with the foil 47 and the chassis 48 fastened thereto, as well as with a locking device 10 arranged in the interior of the U-shaped chassis 48—see FIG. 3. The chassis 48 is shown in a partly broken away view to expose the components of the locking device 10 comprised of a spring element 107 resting against a wall 105 of the chassis chamber 106, and a locking element 108 acted upon by the spring element 107. With two hook-shaped resilient legs 96, 97 the locking element 108 is held under the spring action of the spring element 107 against two holding lugs 98 and 99 provided on the inner wall of the chassis chamber 106 and is arranged for movement in the direction of the wall 105 of the chassis chamber 106 in opposition to the pressure of the spring element 107.

Integrally formed on the locking element 108 is at least one latching element 78, 79 which, when latched with the supporting element 5, reaches behind at least one latching element 38, 39, thus effecting a releasable attachment of the clipper head S to the supporting element 5. The latching elements 78 and 79 are disengaged from the latching elements 38 and 39 by actuating the pushbuttons of the locking device 9 and 10 on which the latching elements 78 and 79 are provided—see FIG. 14—thus enabling the clipper head S to be taken off the supporting element 5.

Figure 15:
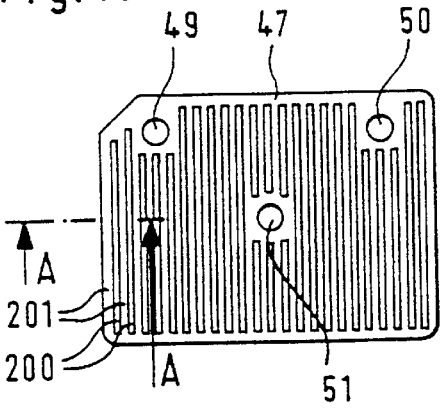
FIG. 15 is a view of a foil having a surface structure formed by elevations and recesses.
Figure 15A:
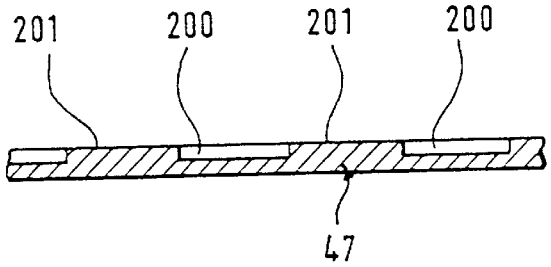
FIG. 15*a* is a part cross sectional view of the foil taken along the line A—A of FIG. 15.

In the embodiment of FIG. 15 and FIG. 15*a*, the foil 47 having through-holes 49, 50, 51 is comprised of a thin metal plate in which groove-type recesses 200 are provided using an embossing or an etching technique. The bar-type elongate elevations 201 between the groove-type elongate recesses 200 form the sliding surface for the clipper blade 4 and the clipper blade 82 of a clipper head S—see FIG. 3. By virtue of the groove-type recesses 200 the sliding surfaces or friction surfaces of the clipper blade 4 and the clipper blade 82 on the foil 47 are significantly reduced. To reduce the friction between the clipper blades 4, 82 and the foil 47 still further, provision may be made for a lubricant in the groove-type recesses 200—see FIG. 20*a*—to lubricate the components which are in sliding relationship with each other.

Figure 16:
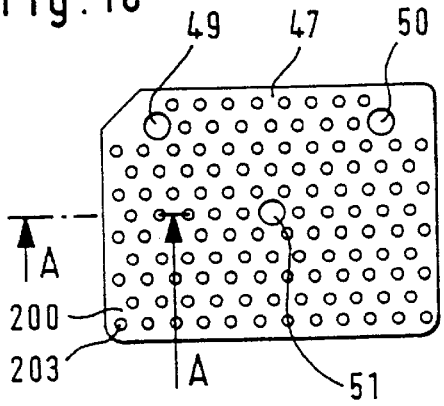
FIG. 16 is a view of a foil having a surface structure formed by partial elevations and recesses.
Figure 16A:
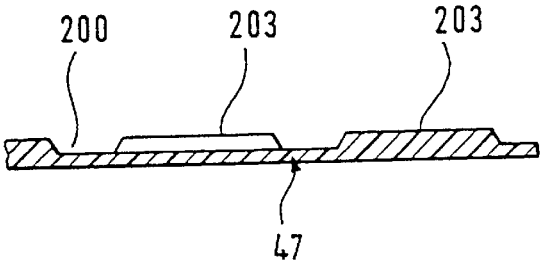
FIG. 16*a* is a part cross sectional view of the foil taken along the line A—A of FIG. 16.

FIG. 16 and FIG. 16*a*show a further embodiment of a surface structure for a foil 47 fabricated from a plastics material.

The dome-shaped elevations 203 which protrude relative to the recesses 200 are produced together with the foil 47 by injection molding techniques. This is a simple and low-cost manufacturing method. To reduce friction still further, a lubricant may be disposed between the dome-shaped elevations 203.

Figure 17:
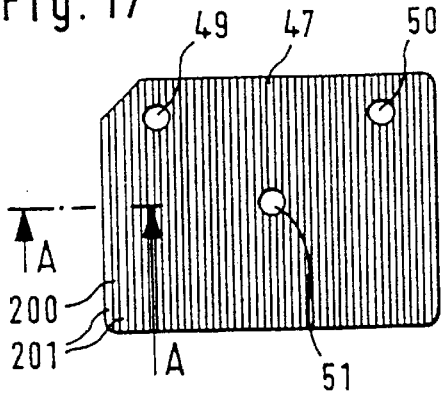
FIG. 17 is a view of a foil having bar-type elevations and groove-type recesses.
Figure 17A:
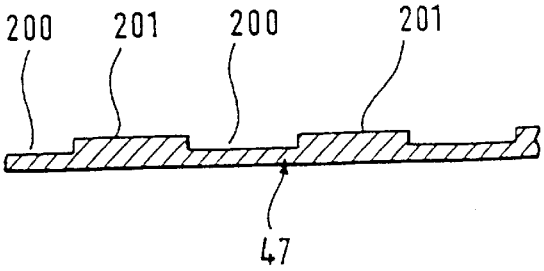
FIG. 17*a* is a part cross sectional view of the foil taken along the line A—A of FIG. 17.

FIG. 17 and FIG. 17*a* show a foil 47 having through-holes 49, 50, 51 and a surface structure formed by bar-type elevations 201 extending across the full width of the foil and groove-type recesses 200 extending parallel to said elevations. The foil 47 may be made of a plastics material with a surface structure obtained by extruding or rolling the foil, or of a metal material whose surface structure is obtained by embossing or etching.

Figure 18:
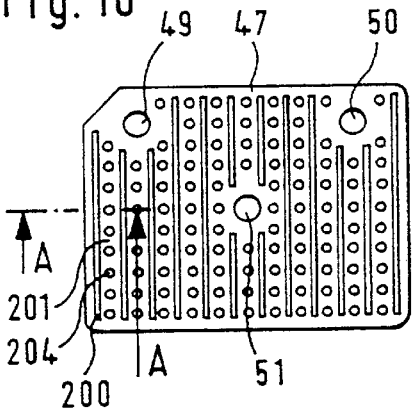
FIG. 18 is a view of a foil having a surface structure formed by a combination of holes, bars and recesses.
Figure 18A:
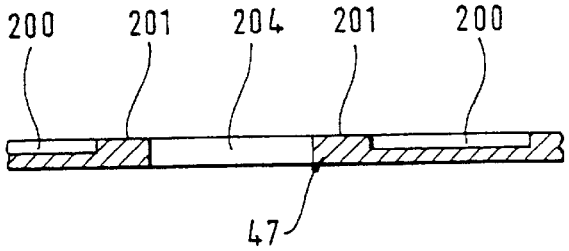
FIG. 18*a* is a part cross sectional view of the foil taken along the line A—A of FIG. 18.

In the embodiment of FIG. 18 and FIG. 18*a* the surface structure of the foil 47 is a combination of bar-type elevations 201, holes 204 and groove-type recesses 200 arranged in alternating sequence.

Figure 19:
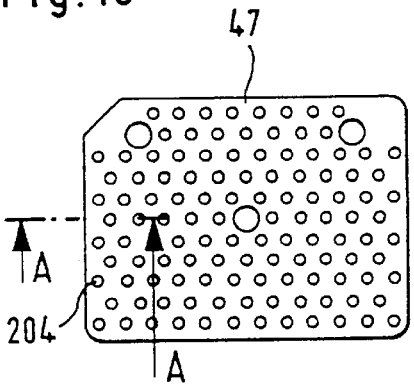
FIG. 19 is a view of a foil having a surface structure formed by holes.
Figure 19A:
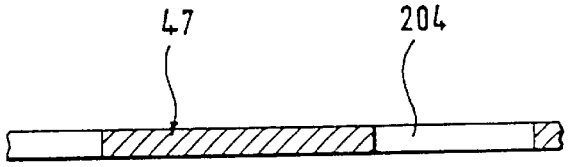
FIG. 19*a* is a part cross sectional view of the foil taken along the line A—A of FIG. 19.

FIG. 19 and FIG. 19*a* show a foil 47 manufacturable from either a plastics or a metal material. In instances where the foil 47 is made of a plastics material the holes 204 are punched. Upon assembly of the foil 47 on the clipper comb 3 a lubricant may be introduced in these holes 204 to reduce friction.

Figure 20:
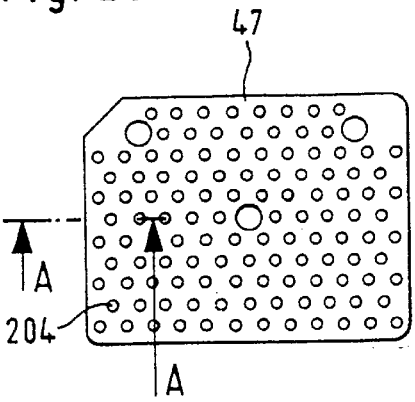
FIG. 20 is a view of a foil having a surface structure formed by holes and recesses.
Figure 20A:
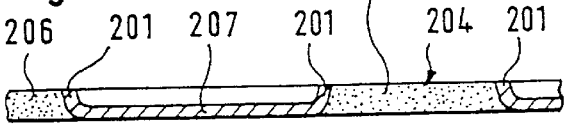
FIG. 20*a* is a part cross sectional view of the foil of FIG. 20 whose surface structure is formed by bars surrounding the holes, taken along the line A—A of that Figure.
Figure 20B:
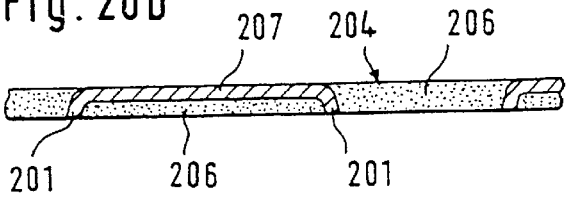
FIG. 20*b* is a further part cross sectional view of the foil taken along the line A—A of FIG. 20.

The embodiments of FIGS. 20, 20*a* and 20*b* show a foil 47 manufacturable, for example, by electroforming techniques and having holes 204 surrounded by bars 207 with bar-type elevations 201.

In the embodiment of FIG. 20*a* the bar-type elevations 201 of the bars 207 engage, for example, the clipper comb 3, so that the movable clipper blade 4, 82 makes engagement with the bars 207—see FIG. 2. To reduce friction a lubricant 206 is received in the holes 204 of the foil 47.

FIG. 20*b* shows a foil constructed like the foil 47 of FIG. 20*a*. In the assembled state the surface of the bars 207 makes engagement with the clipper comb 3, while the bar-type elevations 201 make engagement with the clipper blade 4, 82. This type of arrangement of the foil 47 contributes to significantly reducing the friction between the foil 47 and the clipper blades 4 and 82. A further reduction in friction is accomplished by disposing a lubricant 206 in both the holes 204 and the region between the bars of the bar-type elevations 201.

The method of manufacturing the foil of FIG. 20 to FIG. 20*b* is identical to the method of manufacturing a shaving foil for a dry shaving apparatus.

We claim:

1. A power driven hair clipper, comprising a drive mechanism provided in a housing (1), a clipper head (S) equipped with a clipper comb (3) and a reciprocating clipper blade (4, 82), said clipper blade having a row of cutting teeth (42, 43) and defining an engagement surface (A2) provided opposite said row of cutting teeth, and a foil (47) disposed between the clipper comb (3) and the clipper blade (4, 82) such that the engagement surface (A2) of the clipper blade (4, 82) is carried on the foil (47) in sliding relationship thereto, wherein the clipper comb has a row of comb cutting teeth (40, 41), and in a position of the engagement surface (A2) being carried on the foil (47), the clipper blade (4, 82) is inclined relative to the row of comb cutting teeth (40, 41).

2. The hair clipper as claimed in claim 1, wherein at least a first surface of the foil defines a plurality of recesses facing the engagement surface (A2).

3. A power driven hair clipper, comprising a drive mechanism provided in a housing (1), a clipper head (S) equipped with a clipper comb (3) and a reciprocating clipper blade (4, 82), said clipper blade having a row of cutting teeth (42, 43) and defining an engagement surface (A2) provided opposite said row of cutting teeth, and a foil (47) disposed between the clipper comb (3) and the clipper blade (4, 82) such that the engagement surface (A2) of the clipper blade (4, 82) is carried on the foil (47) in sliding relationship thereto, and wherein at least a first surface of the foil defines a plurality of recesses facing the engagement surface (A2).

4. The hair clipper as claimed in claim 3, wherein the recesses define openings directed towards the engagement surface of the clipper blade.

5. The hair clipper as claimed in claim 3, wherein the foil is thin and generally planar.

6. The hair clipper as claimed in claim 3, wherein the recesses define apertures extending through the foil to a second surface opposite said first surface.

7. The hair clipper as claimed in claim 3, wherein the recesses are formed as blind-end bores.

8. The hair clipper as claimed in claim 3, wherein the recesses are defined between bars.

9. The hair clipper as claimed in claim 3, wherein the recesses are defined by apertures and bars.

10. The hair clipper as claimed in claim 3, wherein the foil is fastened to the clipper comb (3).

11. The hair clipper as claimed in claim 3, wherein the recesses hold a lubricant.

12. The hair clipper as claimed in claim 3, wherein a surface of the foil carrying the engagement surface (A2) of the clipper blade is electroformed.

13. The hair clipper as claimed in claim 3, wherein a surface of the foil carrying the engagement surface (A2) of the clipper blade is formed by embossing.

14. The hair clipper as claimed in claim 3, wherein the first surface of the foil defining the recesses and carrying the engagement surface (A2) of the clipper blade is electroformed.

15. The hair clipper as claimed in claim 3, wherein the first surface of the foil defining the recesses and carrying the engagement surface (A2) of we clipper blade is formed by embossing.

16. The hair clipper as claimed in claim 3, wherein the foil (47) is formed of a metal.

17. A power driven hair clipper, comprising a drive mechanism provided in a housing (1), a clipper head (S) equipped with a clipper comb (3) and a reciprocating clipper blade (4, 82), said clipper blade having a row of cutting teeth (42, 43) and defining an engagement surface (A2) provided opposite said row of cutting teeth, and a foil (47) disposed between the clipper comb (3) and the clipper blade (4, 82) such that the engagement surface (A2) of the clipper blade (4, 82) is carried on the foil (47) in sliding relationship thereto, and further comprising a chassis (48) overlying the foil and fastening the foil to the clipper comb (3).

18. The hair clipper as claimed in claim 17, wherein the chassis defines a mounting surface onto which an assembly including the reciprocating clipper blade is mounted.

19. The hair clipper as claimed in claim 17, wherein at least a first surface of the foil defines a plurality of recesses facing the engagement surface (A2).

20. A power driven hair clipper, comprising a drive mechanism provided in a housing (1), a clipper head (S) equipped with a clipper comb (3) and a reciprocating clipper blade (4, 82), said clipper blade having a row of cutting teeth (42, 43) and defining an engagement surface (A2) provided opposite said row of cutting teeth, and a foil (47) disposed between the clipper comb (3) and the clipper blade (4, 82) such that the engagement surface (A2) of the clipper blade (4, 82) is carried on the foil (47) in sliding relationship thereto, and wherein the foil (47) is formed of a plastics material.

21. The hair clipper as claimed in claim 20, wherein at least a first surface of the foil defines a plurality of recesses facing the engagement surface (A2).

* * * * *

UNITED STATES PATENT AND TRADEMARK OFFICE

CERTIFICATE OF CORRECTION

PATENT NO. : 6,421,922 B2
DATED : July 23, 2002
INVENTOR(S) : Beutel et al.

It is certified that error appears in the above-identified patent and that said Letters Patent is hereby corrected as shown below:

Column 11,
Line 3, change “we clipper” to -- the clipper --.

Signed and Sealed this

Fourteenth Day of January, 2003

JAMES E. ROGAN
*Director of the United States Patent and Trademark Office*